US007183481B2

(12) United States Patent
Hales

(10) Patent No.: US 7,183,481 B2
(45) Date of Patent: Feb. 27, 2007

(54) APPARATUS AND METHOD FOR EMBEDDING CONTENT WITHIN A MIDI DATA STREAM

(75) Inventor: Steve Alex Hales, San Francisco, CA (US)

(73) Assignee: Danger, Inc., Palo Alto, CA (US)

( * ) Notice: Subject to any disclaimer, the term of this patent is extended or adjusted under 35 U.S.C. 154(b) by 0 days.

(21) Appl. No.: 10/262,441

(22) Filed: Sep. 30, 2002

(65) Prior Publication Data

US 2004/0123727 A1 Jul. 1, 2004

(51) Int. Cl.
*G10H 7/00* (2006.01)

(52) U.S. Cl. ..... 84/645; 84/609; 84/649; 84/477 R

(58) Field of Classification Search ..... 84/600–602, 84/609–611, 615, 626, 649–651, 653, 662, 84/477 R See application file for complete search history.

(56) References Cited

U.S. PATENT DOCUMENTS 5,247,129 A * 9/1993 Nozaki et al. ..... 84/615
5,922,982 A * 7/1999 Ishibashi ..... 84/615
6,008,783 A * 12/1999 Kitagawa et al. ..... 345/39
6,094,587 A * 7/2000 Armanto et al. ..... 455/567
6,342,663 B1 * 1/2002 Kato ..... 84/470 R
6,365,820 B1 * 4/2002 Kondo et al. ..... 84/658
6,392,131 B2 * 5/2002 Boyer ..... 84/424
6,600,097 B2 * 7/2003 Shiiya ..... 84/609
2004/0180700 A1 * 9/2004 Hubbe et al. ..... 455/567

* cited by examiner

*Primary Examiner*—Marlon Fletcher
(74) *Attorney, Agent, or Firm*—Blakely, Sokoloff, Taylor & Zafman, LLP

(57) ABSTRACT

A method implemented on a data processing device is described comprising: generating supplemental data defining one or more characteristics of one or more light-emitting diodes ("LEDs") on the data processing device; embedding the supplemental data within a musical instrument digital interface ("MIDI") stream; decoding the supplemental data concurrently with decoding the MIDI stream; and modifying the one or more characteristics of one or more of the LEDs responsive to decoding the supplemental data.

29 Claims, 8 Drawing Sheets

APPARATUS AND METHOD FOR EMBEDDING CONTENT WITHIN A MIDI DATA STREAM

BACKGROUND

1. Field of the Invention

This invention relates generally to the field of data processing. More particularly, the invention relates to an apparatus and method for encoding and decoding multimedia content and other data within a MIDI stream.

2. Description of the Related Art

Musical Instrument Digital Interface ("MIDI") is a protocol used for interchanging musical information between musical instruments, synthesizers and computers. It defines the codes for a musical event, including, for example, the start of a note, the note's pitch, length, volume and various other musical attributes (e.g., instrument, vibrato level, . . . etc). It also defines codes for various button, dial and pedal adjustments used on most synthesizers. Since the advent of "General MIDI," which defines a standard set of MIDI instruments, MIDI has become widely used for musical backgrounds in multimedia applications.

Instead of digitizing and recording the actual sound waves (e.g., as in a tape recorder), a computer with a MIDI interface stores the music as keystroke and control codes. As such, a MIDI recording typically consumes significantly less space than an actual digitized audio recording. Once a MIDI recording is stored on a hard drive or other mass storage device, the recording can then be edited in an entirely different manner than with conventional recording. For example, the rhythm can be changed by editing the timing codes in the MIDI messages and the key of the original recording can easily be transposed (e.g., from B major to D major). Moreover, unwanted notes or groups of notes can easily be removed and/or replaced.

SUMMARY

A method implemented on a data processing device is described comprising: generating supplemental data defining one or more characteristics of one or more light-emitting diodes ("LEDs") on the data processing device; embedding the supplemental data within a musical instrument digital interface ("MIDI") stream; decoding the supplemental data concurrently with decoding the MIDI stream; and modifying the one or more characteristics of one or more of the LEDs responsive to decoding the supplemental data.

BRIEF DESCRIPTION OF THE DRAWINGS

A better understanding of the present invention can be obtained from the following detailed description in conjunction with the following drawings, in which.

DETAILED DESCRIPTION OF PREFERRED EMBODIMENTS

Figure 1A:
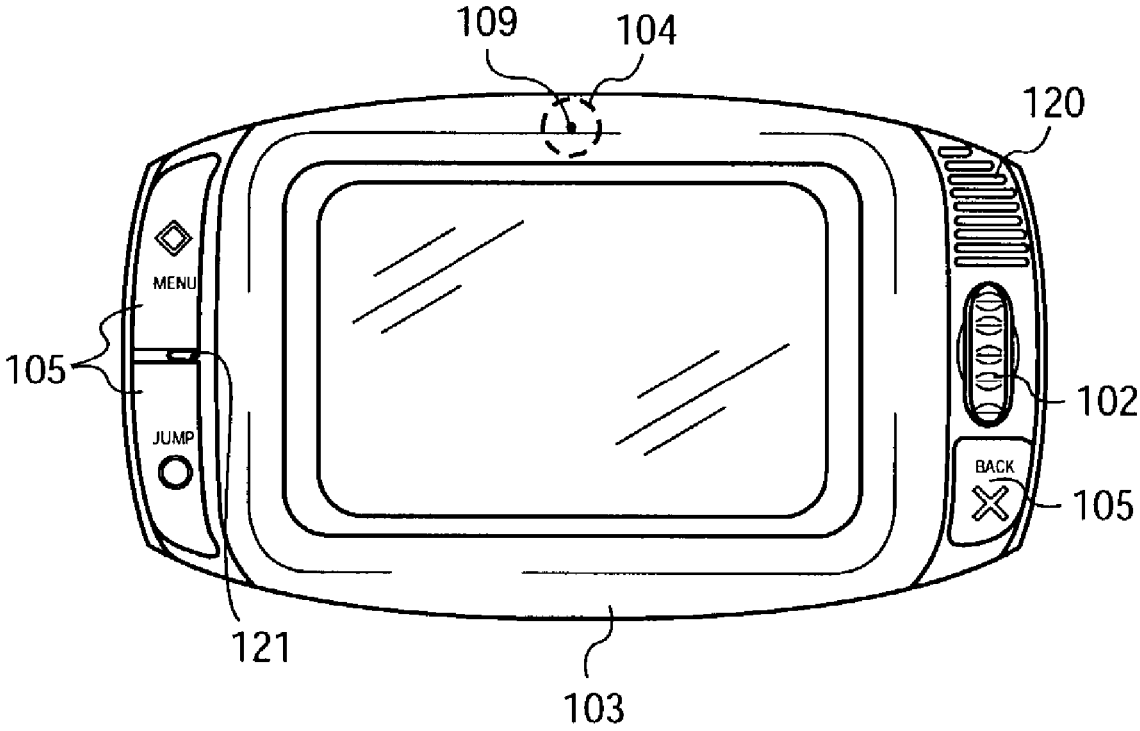
FIG. 1*a–d* illustrate an exemplary data processing device on which embodiments of the invention are implemented.
Figure 1B:
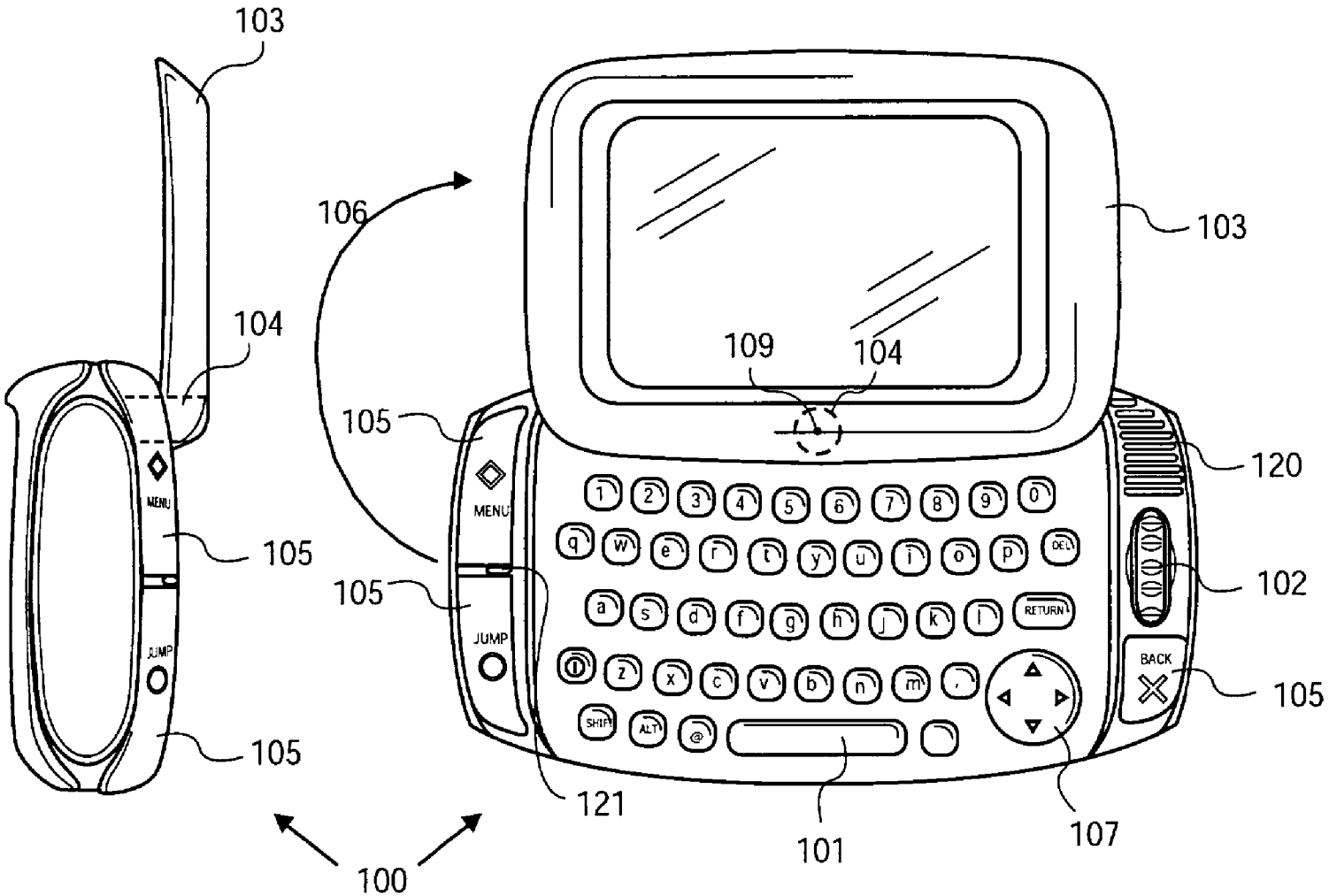
Figure 1C:
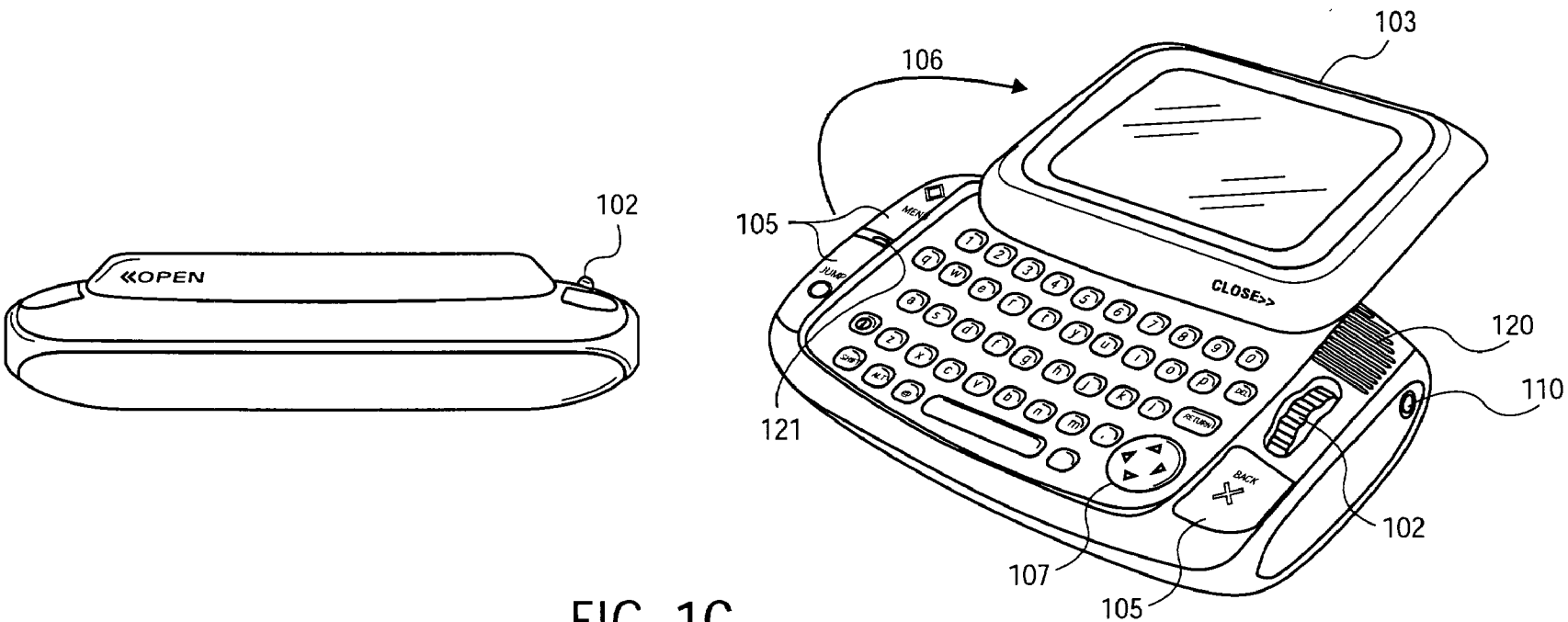

Described below is a system and method for integrating multimedia content and other data within a MIDI data stream. Throughout the description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

An Exemplary Data Processing Device

Embodiments of the invention may be implemented on a data processing device such as that described in co-pending application entitled Adjustable Data Processing Display, Ser. No. 09/714,320, Filed Nov. 15, 2000, which is assigned to the assignee of the present application and which is incorporated herein by reference. Certain embodiments of the data processing device will now be described followed by a detailed description of an apparatus and method for embedding content within a MIDI data stream. As an initial matter, however, it should be noted that the specific data processing device described below is not required for implementing the underlying principles of the invention. Rather, the invention may be implemented on virtually any type of data processing device including standard personal computers, personal digital assistants and wireless telephones.

FIGS. 1*a–d* illustrate a data processing device 100 with an adjustable display 103 according to one embodiment of the invention. In one embodiment, the data processing device 100 is comprised of a keyboard 101, a control knob/wheel 102 (e.g., for scrolling between menu items and/or data), and a set of control buttons 105 (e.g., for selecting menu items and/or data).

In one embodiment, the display 103 is pivotally coupled to the data processing device 100. More specifically, the display 103 pivots around a pivot point 109, located within a pivot area 104, from a "closed" position illustrated in FIG. 1*a* to an "open" position illustrated in FIGS. 1*b–c*. When in a closed position, the display 103 covers the keyboard 101 thereby decreasing the size of the device 100 and protecting the keyboard 101. Even when the display is in a closed position, however, the control knob 102 and control buttons 105 are exposed and therefore accessible by the user. The motion of the display 103 from a closed position to an open position is indicated by motion arrow 106 illustrated in FIGS. 1*b–c*. As illustrated, when in an open position, the keyboard 101 is fully exposed. Accordingly, it will be appreciated that the display is viewable, and data is accessible by the user in both an open and a closed position (although access to the keyboard is only provided in an open position).

In one embodiment, a switch within the device 100 (not shown) is triggered when the display 103 is moved from one position to the next. Hardware/software within the device may be configured to read the position of the switch and invert images rendered on the display based on the switch position. Accordingly, images are rendered on the display 103 right-side-up, regardless of whether the display 103 is in an open or a closed position. In addition, in one embodiment, a different user interface (or other operating systems functions) may be triggered by the switch. For example, when the display is moved into a closed position, a user interface may be displayed which is more easily navigable with only the control buttons 105 and control knob 102 (i.e., without the use of the keyboard 101). Various other interface functions may be triggered by the switch consistent with the underlying principles of the invention. Moreover, various different types of switches may be employed on the device 100 including standard mechanical switches, electrical switches (e.g., capacitive/magnetic switches), or any combination thereof.

If standard electrical wiring is used to electrically couple the data processing device 100 and the display 103, the pivot area 104 should be wide enough to accommodate the wiring. However, various different types of electrical connections may be employed between the data processing device 100 and the display 103 while still complying with the underlying principles of the invention. For example, in one embodiment, the display 103 may be communicatively coupled to the processing device 100 via a wireless connection (e.g., using the Bluetooth standard, IEEE 802.11b, a capacitive coupling, . . . etc). If configured with a wireless connection, the display 103 may be detachable from the processing device 100.

Moreover, various types of physical connections may be used to rotatably mount the display 103 to the processing device 100. For example, in one embodiment, the device 100 is cooperatively mated to the display 103 with a set of circular guide rails or tracks (not shown).

The control knob 102 and control buttons 105 may be programmed to perform various functions within applications executed on the processing device 100. For example, if an email client application is executed on the device 100, the control knob 102 may be configured to scroll through the list of email messages within the user's inbox (e.g., with the current email message highlighted on the display 103). One of the control buttons 105 may be configured to select a particular email message within the list. A second control button may be configured as a "back" button, allowing the user to back out of selected email messages and/or to move up through the menu/folder hierarchy. A third control button may be configured to bring the user to a desired location within the email application (e.g., to the top of the menu/folder hierarchy) or within the operating system executed on the processing device 100.

In one embodiment, the functions to be executed by the buttons 105 and control knob 102 may be programmed by the end-user. In addition, various different control elements may be employed on the processing device 100 while still complying with the underlying principles of the invention.

In one embodiment, a cursor control element 107 is provided within the keyboard 101. The cursor control element 107 acts like a typical set of control keys, providing for movement of a cursor in any direction specified by the user (i.e., up, down, left and right).

In one embodiment, the data processing device 100 is also provided with audio telephony (e.g., cellular) capabilities. To support audio telephony functions, the embodiment illustrated in FIGS. 1*a–d* includes a speaker 120 for listening and a microphone 121 for speaking during a telephone conversation. Notably, the speaker 120 and microphone 121 are positioned at opposite ends of the data processing device 100 and are accessible when the screen 103 is in a closed position and an open position.

Figure 1D:
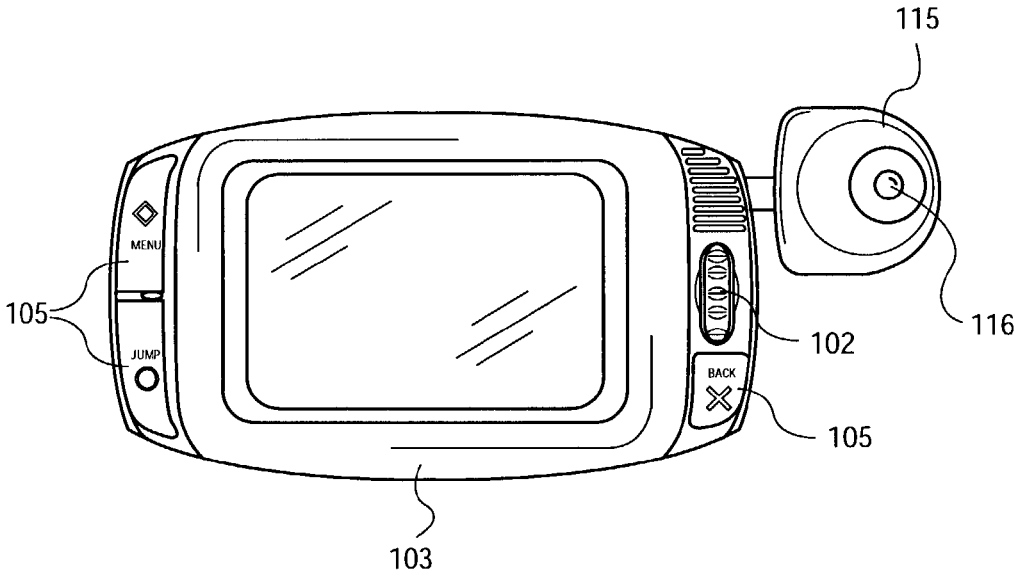

As illustrated in FIG. 1*d*, one embodiment of the data processing device 100 also includes a detachable camera 115 for capturing images. In FIG. 1*d*, the lens 116 of the camera 115 is facing out of the plane of the figure. The camera may be inserted into an input port 110 such as that shown in FIG. 1*c*, and may be rotatable around an axis defined by the input orientation of the input port. In one embodiment, the input port 110 is the same port as that used to communicatively couple a telephone headset (now shown) to the data processing device 100.

In one embodiment, one or more light emitting diodes ("LEDs") or similar light-producing elements are embedded within or beneath the control knob 102. Accordingly, in this embodiment the control knob is comprised of a translucent material so that the LED colors are viewable by the end user. In one embodiment, a red, a blue and a green LED are provided. By manipulating the values of red, green and blue (e.g., via an LED device driver), virtually any color within the visible spectrum may be generated. The LED colors may be manipulated in a variety of different circumstances, several of which are described below.

Apparatus and Method for Embedding Content Within a MIDI Data Stream

In one embodiment, the data processing device illustrated in FIGS. 1*a–d* includes a MIDI controller capable of processing MIDI data to render MIDI audio content. In addition, in one embodiment, the data processing device includes a supplemental MIDI data decoder capable of extracting and processing supplemental data (e.g., multimedia content) embedded within the MIDI data stream.

Figure 2:
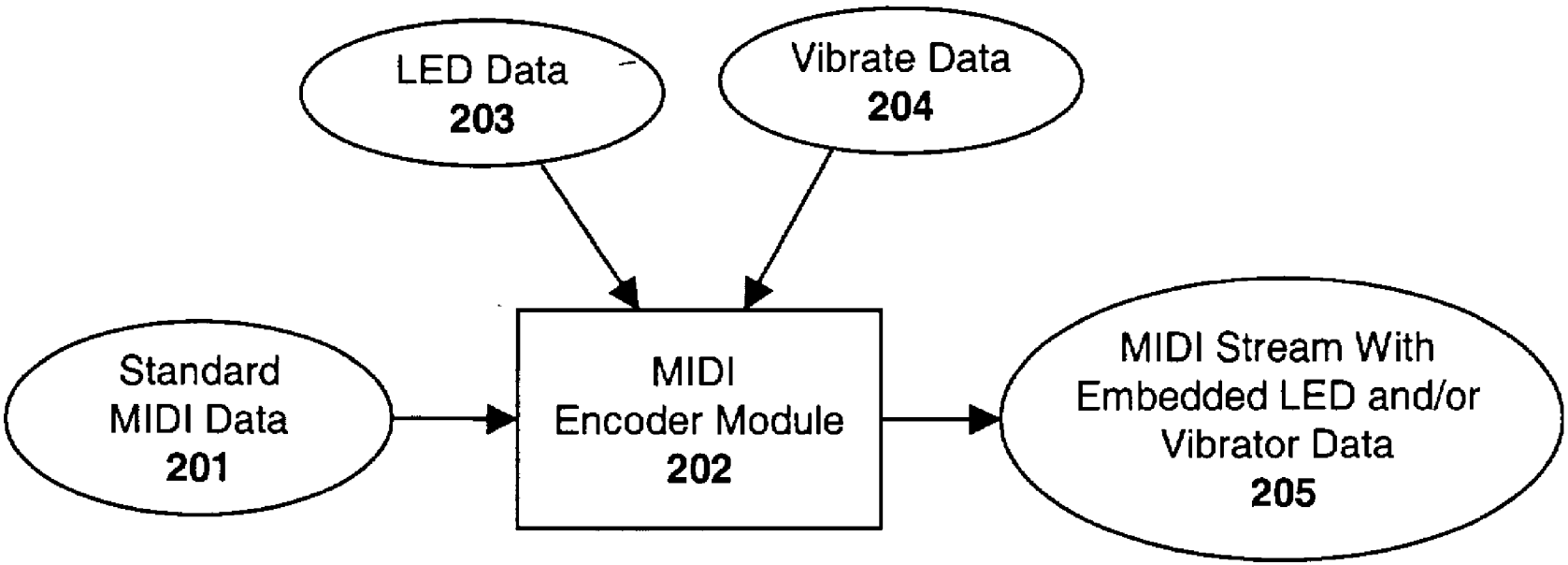
FIG. 2 illustrates a MIDI encoder module according to one embodiment of the invention.

FIG. 2 generally illustrates one embodiment of a MIDI encoder module 202 used to encode the supplemental data within the MIDI stream. The encoder module 202 embeds two types of supplemental data within the standard MIDI data stream 201: LED data 203 defining LED colors to be synchronized with playback of the MIDI audio; and vibrate data 204 indicating points in time during the playback of the MIDI audio at which the data processing device should vibrate. It will be appreciated that various additional types of supplemental data may be encoded within the MIDI stream while still complying with the underlying principles of the invention.

In one embodiment, the MIDI encoder module 202 encodes the supplemental data within MIDI fields designated for "General Purpose Controller" data (e.g., Status Byte=176; Second Byte=16–19). Alternatively, or in addition, one of the various MIDI fields designated as "Undefined" may be used (e.g., Status Byte=176; Second Byte=20–31).

Figure 4:
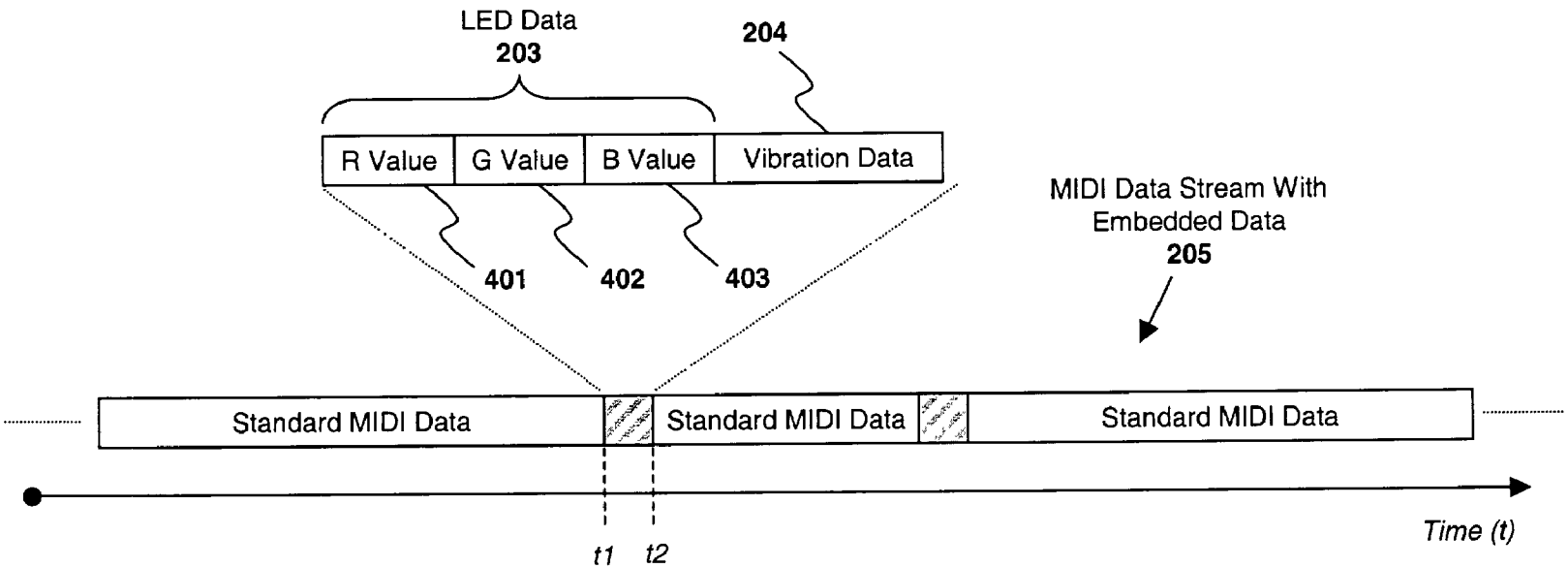
FIG.4 illustrates a MIDI data stream with embedded data according to one embodiment of the invention.

FIG. 4 illustrates an exemplary MIDI data stream 205 generated by the MIDI encoder module 202 which contains LED and/or vibrate data 203 and 204, respectively, embedded at specific points (e.g., t1–t2) so as to be synchronized with the audio generated by the standard MIDI data. For example, LED data defining a bright red LED color may be embedded at particularly loud and/or fast points within a musical composition. Conversely, a dark blue or purple color may be selected for softer and/or slower points within the composition. Of course, the underlying principles of the invention are not limited to any particular color and/or synchronization scheme.

In the example shown in FIG. 4, the LED data is comprised of a red component 401, a green component 402 and a blue component 403. By manipulating the levels of each component, the MIDI encoder module 202 may generate LED data defining any color and any brightness level within the visible spectrum. Various alternate color encoding schemes may also be used including, by way of example but not limitation, Hue Saturation Value ("HSV"), Hue Saturation Brightness ("HSB"), and luminance/chrominance components ("YUV").

A the vibration data 204 defines points in time at which the device should vibrate, a vibration level and/or a vibration period. In one embodiment, the encoder module 202 embeds the vibration data 204 at points at which the bass of the musical composition rises above a specified threshold value, thereby simulating heavy bass on a relatively small device. The specified threshold value may be based on both volume and pitch. For example, the encoder module 202 may specify that only notes below a low C ("C3") should vibrate, and only if the volume level is above a specified threshold.

Figure 3:
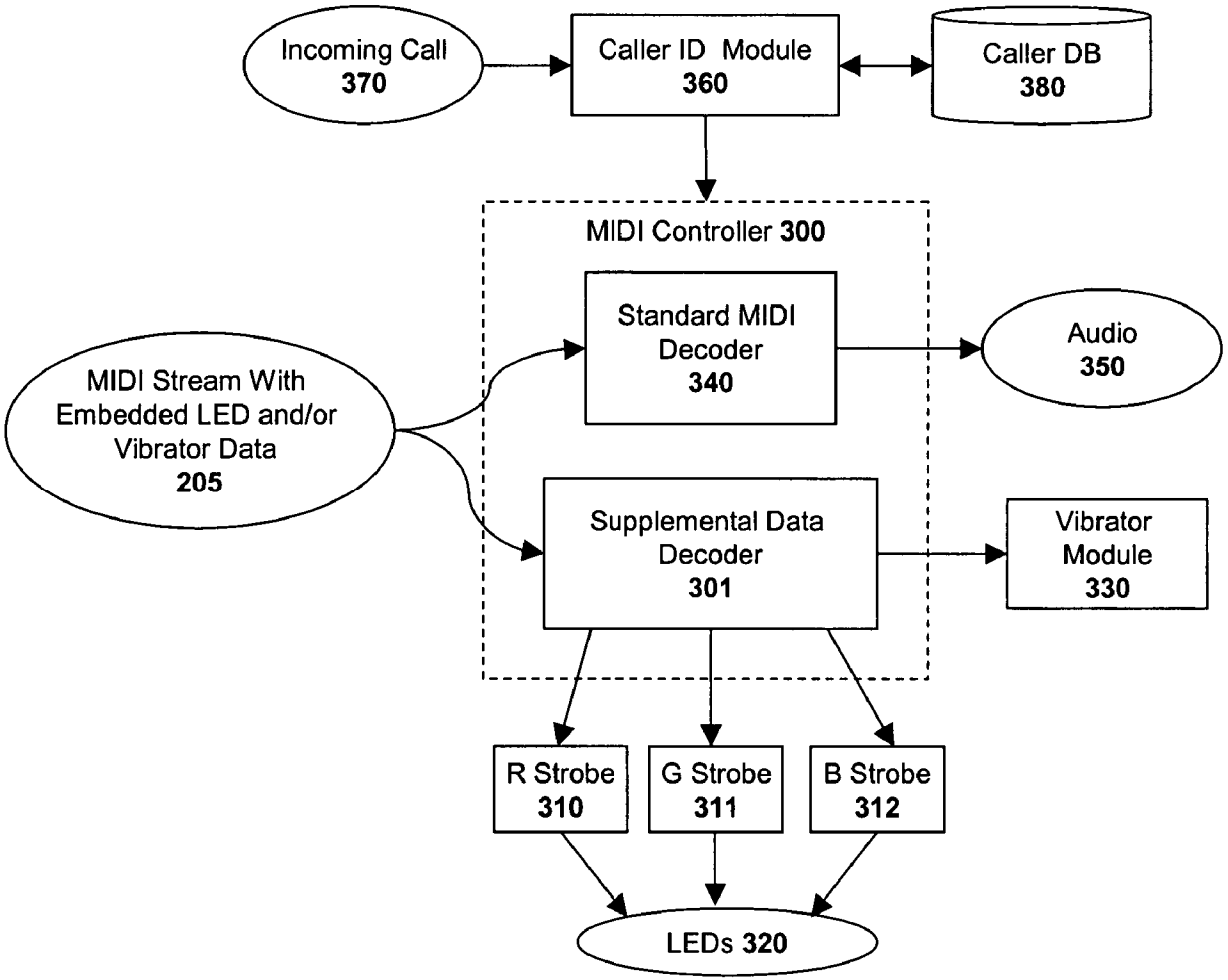
FIG. 3 illustrates a MIDI decoder module according to one embodiment of the invention.

FIG. 3 illustrates a MIDI controller 300 according to one embodiment of the invention. The MIDI controller 300 is comprised of both a standard MIDI decoder 340 for decoding the standard MIDI audio data and a supplemental data decoder 301 for decoding the LED data 203 and vibration data 204 (or other data embedded within the MIDI stream). In one embodiment, the supplemental data decoder 301 is comprised of a set of registers for storing each of the extracted red, green and blue values and/or the vibration values. Alternatively, the supplemental decoder module 301 may store each of these values in single, contiguous memory space (e.g., with regions of the memory space dedicated to storing each value).

In the particular embodiment illustrated in FIG. 3, the supplemental data decoder 301 controls a red strobe module 310, a green strobe module 311, and a blue strobe module 312 based on the red, green and blue values 401, 402, and 403, respectively, extracted from the MIDI stream. More specifically, based on the control signals provided by the supplemental data decoder 301, the strobe modules control the rate at which the red, green and blue LEDs 320 are strobed, and thereby change the color and brightness generated by the LEDs 320 (modifying LED brightness by strobing is well known in the art).

In one embodiment the "control signals" provided to the strobe modules 310–312 by the supplemental data decoder 301 may simply be the red, green and blue values extracted from the MIDI data stream and temporarily stored in memory. The strobe modules 310–312 will then translate these values to strobe rate values and independently adjust each of their strobe levels accordingly. Alternatively, the supplemental data decoder 301 may itself translate the underlying red, green and blue values into a strobe rate value, which it will then provide to the red green and blue strobe modules, 310, 311, and 312, respectively. The underlying principles of the invention remain the same regardless of which portion of the system converts the red, green and blue values to a strobe rate value.

As mentioned above, in addition to LED values, the supplemental data decoder 301 also extracts vibration values embedded within the MIDI stream. The supplemental data decoder 301 controls a vibrator module 330 configured on the data processing device based on the extracted vibration values. As mentioned above, the vibration values may indicate the level of vibration and/or the period of vibration.

In one embodiment, the MIDI controller 300 processes MIDI streams upon receipt of an incoming call to the data processing device (i.e., and thereby generates an audible, visible and/or physical indication of the incoming call). In the embodiment illustrated in FIG. 3, an indication of an incoming call is provided to the MIDI controller 300 by a caller identification module 360. In one embodiment, the caller identification module 360 initially attempts to identify the number of the incoming call 370 using various caller identification techniques such as, for example, automatic number identification ("ANI"). If the caller identification module 360 identifies the number, it then performs a lookup in a caller database 380 stored on the data processing device (e.g., in Flash memory). The user may associate certain MIDI data streams with certain callers within the caller database 380. Accordingly, if the caller identification module 360 locates a particular caller within the caller database 380, it extracts the identity of the MIDI data stream 205 associated with the caller (e.g., the MIDI file name) and provides the identity of the MIDI data stream to the MIDI controller 300. The MIDI controller then renders the identified MIDI data stream, including the embedded LED and vibration data 203 and 204, respectively, as described above. If the caller identification module 380 is unable to locate the caller within the caller database 380, it may identify a default MIDI data stream to the MIDI controller 300. Alternatively, it may not provide any indication to the MIDI controller (i.e., the data processing device will "ring" in a standard manner, without using MIDI).

In one embodiment, the MIDI controller 300 processes the MIDI streams as described above upon receipt of any type of incoming electronic message including, by way of example but not limitation, incoming e-mail messages and instant messages.

In one embodiment, the user may create his/her own MIDI data streams, store the data streams on the data processing device, and (as mentioned above) associate the data streams with potential callers. One example of a particular MIDI data stream used to indicate an incoming call will now be described with respect to FIG. 5. The first graph 500 illustrated in FIG. 5 indicates how the volume of the MIDI audio (or standard telephone ringer) will change over time in response to an incoming call. In one embodiment, the volume is manipulated using the standard MIDI protocol. The second graph 501 indicates how the LED brightness and vibration level or duration will change over time in response to an incoming call.

As illustrated, when an incoming call is initially received, the MIDI audio or standard ringer volume is set to zero. The volume remains at zero for some predetermined period of time t1. During the same period of time, however, the vibrate level/duration and/or the LED brightness is at the highest level. Following the initial time period, the MIDI audio or ringer volume will consistently increase up to its maximum at t2. During the same period of time, the LED brightness and/or vibration level/duration will continually decrease until it reaches zero at t2.

Thus, the user will initially be notified of a call using inaudible notification techniques (a useful feature, for example, if the user is in a meeting). However, if the user does not answer the call for a specified period of time, the data processing device/wireless telephone will begin generating an audible notification—at a low volume at first, gradually increasing to its maximum value.

Figure 5:
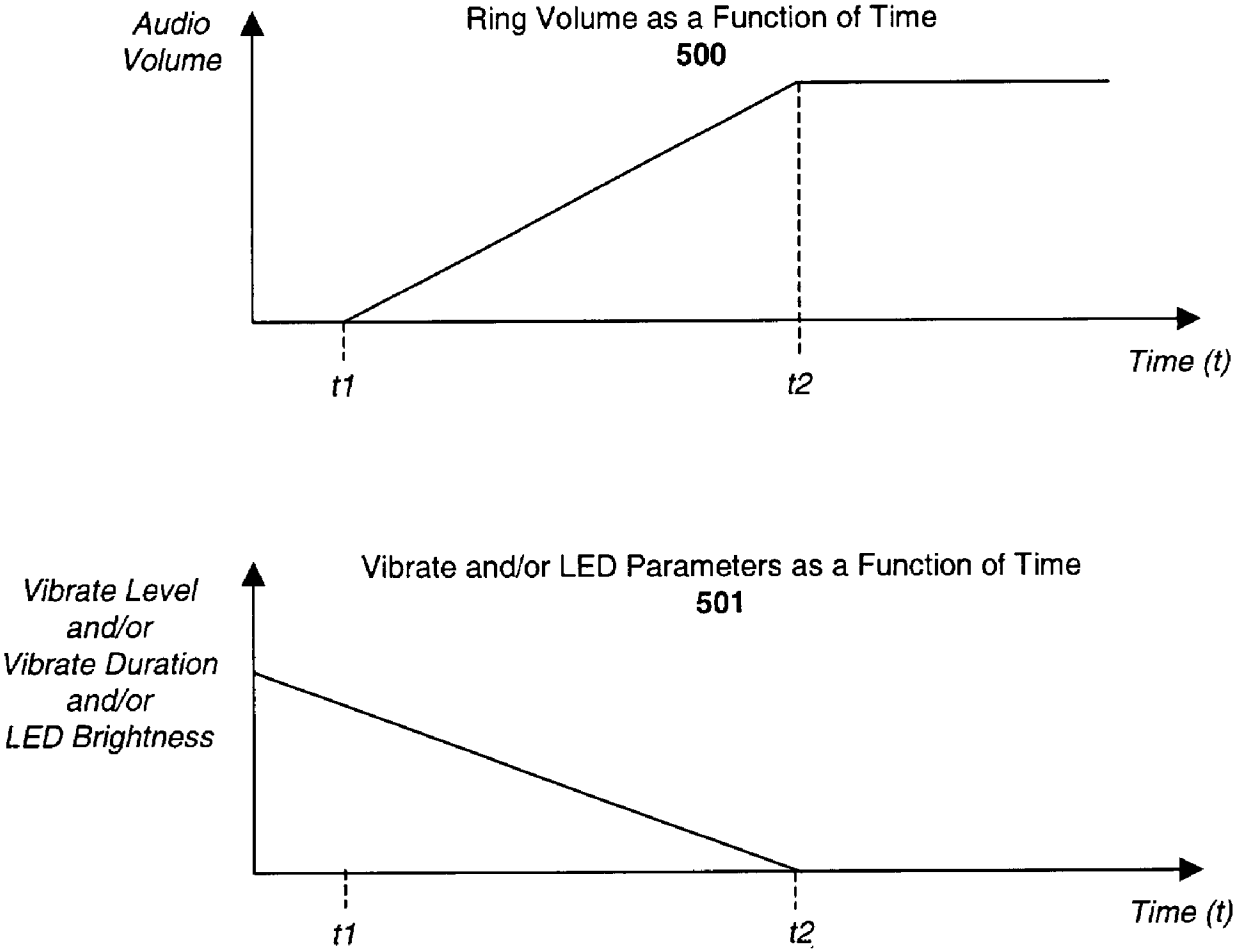
FIG. 5 illustrates audio volume and vibration characteristics generated in response to an incoming call according to one embodiment of the invention.

It should be noted that the specific audio, LED, and vibration parameters illustrated in FIG. 5 are for the purpose of illustration and should not be read to limit the scope of the present invention. A virtually unlimited number of audio, LED and vibration combinations may be configured on the data processing device while still complying with the underlying principles of the invention.

In one embodiment, the user may select from several predetermined incoming call settings such as those illustrated in FIG. 5. In addition, in one embodiment, the user may specify her/her own incoming call notification settings. For example, the user may create a MIDI stream/file with audio characteristics such as those illustrated in graph 500. In addition, the user may embed supplemental LED/vibrate data within the MIDI stream/file having the characteristics shown in graph 501.

Embodiments of the invention may include various steps as set forth above. The steps may be embodied in machine-executable instructions which cause a general-purpose or special-purpose processor to perform certain steps. Alternatively, these steps may be performed by specific hardware components that contain hardwired logic for performing the steps, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, ROMs, RAMs, EPROMs, EEPROMs, magnetic or optical cards, propagation media or other type of media suitable for storing or transmitting electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

Throughout the foregoing description, for the purposes of explanation, numerous specific details were set forth in order to provide a thorough understanding of the invention. It will be apparent, however, to one skilled in the art that the invention may be practiced without some of these specific details. For example, although LED brightness is controlled via strobe units in the embodiments described above, other brightness control mechanisms may be employed while still complying with the underlying principles of the invention. Moreover, other visual effects may be controlled by embedding supplemental data within the MIDI data stream. For example, the characteristics of the data processing device's LCD screen 103 may be manipulated in addition to the LED embedded within the control knob 102. For example, the backlight for LCD screen may be turned on or off and the contrast of the LCD screen may be modified. Accordingly, the scope and spirit of the invention should be judged in terms of the claims which follow.

What is claimed is:

1. A method implemented on a data processing device comprising:

generating first supplemental data defining one or more characteristics of one or more light-emitting diodes ("LEDs") on said data processing device wherein the first supplemental data comprises non-musical instrument digital interface ("MIDI") data;

associating the first supplemental data with a first user;

embedding said first supplemental data within a musical instrument digital interface ("MIDI") stream;

receiving a telephone call and/or electronic message from the first user;

identifying the first user;

responsively decoding said first supplemental data concurrently with decoding MIDI data within said MIDI stream; and modifying said one or more characteristics of one or more of said LEDs responsive to decoding said first supplemental data.

2. The method as in claim 1 wherein one of said characteristics comprises the level of brightness of said one or more LEDs.

3. The method as in claim 1 wherein said LEDs comprise a red LED, a green LED and a blue LED.

4. The method as in claim 3 wherein said first supplemental data comprises red data defining a brightness level of said red LED, green data defining a brightness level of said green LED and blue data defining a brightness of said blue LED.

5. The method as in claim 4 wherein said first supplemental data defines a particular color generated by independently manipulating said brightness levels of each of said LEDs.

6. The method as in claim 1 wherein one of said characteristics comprises a color of said one or more LEDs.

7. The method as in claim 1 wherein embedding comprises embedding said first supplemental data within fields of said MIDI data stream reserved for general purpose controllers.

8. The method as in claim 1 wherein embedding comprises embedding said first supplemental data at points within said MIDI stream such that said characteristics of said LEDs are modified in synchronization with audio generated by said MIDI stream.

9. The method as in claim 1 further comprising:

generating additional portions of said first supplemental data defining one or more vibration characteristics of a vibrator module coupled to said data processing device;

embedding said additional portions of said first supplemental data within said musical instrument digital interface ("MIDI") stream;

in response to receiving said call and/or said electronic message from said first user, decoding said additional portions of said first supplemental data concurrently with decoding said MIDI stream; and modifying said one or more characteristics of said vibrator module responsive to decoding said additional portions of said first supplemental data.

10. The method as in claim 9 wherein modifying further comprises:

causing said vibrator module to vibrate in a predetermined vibration pattern associated with said first user.

11. The method as in claim 9 wherein modifying further comprises modifying a vibration level at which said vibrator module vibrates.

12. The method as in claim 9 wherein said supplemental data causes one of said one or more LEDs to increase in brightness over a defined period of time and wherein said additional supplemental data causes said vibrator module to increase its vibration level or its vibration rate over said defined period of time.

13. The method as in claim 1 wherein said first supplemental data and said MIDI stream are decoded responsive to an incoming telephone call.

14. The method as in claim 1 wherein said first supplemental data and said MIDI stream are decoded responsive to an incoming electronic message.

15. A portable data processing device comprising:

a musical instrument digital interface ("MIDI") controller including a MIDI decoder to decode MIDI data within a first MIDI stream; and a supplemental data decoder to decode supplemental data embedded within said MIDI stream and to responsively modify one or more characteristics of one or more light emitting diodes ("LEDs") configured on said data processing device, wherein the supplemental data comprises non-MIDI data;

a user database to store an association between the first MIDI stream and a first user;

a caller identification module to identify the first user in response to receipt of a telephone call and/or electronic message from the first user, wherein in response to identification of the first user, the supplemental data decoder to responsively decode said first supplemental data concurrently with the MIDI decoder decoding said MIDI stream.

16. The data processing device as in claim 15 wherein one of said characteristics comprises the level of brightness of said one or more LEDs.

17. The data processing device as in claim 15 wherein said LEDs comprise a red LED, a green LED and a blue LED.

18. The data processing device as in claim 17 wherein said supplemental data comprises red data defining a brightness level of said red LED, green data defining a brightness level of said green LED and blue data defining a brightness of said blue LED.

19. The data processing device as in claim 18 wherein said supplemental data defines a particular color generated by independently manipulating said brightness levels of each of said LEDs.

20. The data processing device as in claim 15 wherein one of said characteristics comprises a color of said one or more LEDs.

21. The data processing device as in claim 15 wherein said supplemental data is embedded within fields of said MIDI data stream reserved for general purpose controllers.

22. The data processing device as in claim 15 wherein said supplemental data are embedded at points within said MIDI stream such that said characteristics of said LEDs are modified in synchronization with audio generated by said MIDI stream.

23. The data processing device as in claim 15 wherein said supplemental data further comprises vibration data defining one or more vibration characteristics of a vibrator module coupled to said data processing device and wherein, in response to said vibration data, said supplemental data decoder modifies one or more characteristics of a vibration module.

24. The data processing device as in claim 23 wherein one of said characteristics comprises a vibration pattern of said vibration module.

25. The data processing device as in claim 23 wherein one of said characteristics comprises a vibration level of said vibration module.

26. The data processing device as in claim 23 wherein said supplemental data causes one of said one or more LEDs to increase in brightness over a defined period of time and also causes said vibrator module to increase its vibration level or its vibration rate over said defined period of time.

27. The data processing device as in claim 16 wherein said brightness level of said one or more LEDs is modified by adjusting a strobe rate for said one or more LEDs.

28. A method comprising:

storing a series of musical instrument digital interface ("MIDI") files on a data processing device, said MIDI files containing supplemental data identifying a series of LED colors or physical device vibration patterns, wherein the supplemental data comprises non-MIDI data;

storing an association between each of the MIDI files and one or more users;

identifying a first user in response to receipt of a telephone call and/or electronic message from the first user, using the association to identify a first MIDI file associated with the first user;

decoding audio content from said first MIDI file to generate audio; and decoding the first supplemental data concurrently with the audio content to generate said series of LED colors or said device vibration patterns on said data processing device.

29. The method as in claim 28 wherein supplemental data identifies a combination of both LED colors and device vibration patterns.

* * * * *